US007456137B2

(12) United States Patent
Wilburn et al.

(10) Patent No.: US 7,456,137 B2
(45) Date of Patent: Nov. 25, 2008

(54) COMPOSITIONS COMPRISING AT LEAST ONE CARBODIIMIDE

(75) Inventors: Bruce Wilburn, Glen Allen, VA (US); Chintan Ved, Westland, MI (US)

(73) Assignees: Afton Chemical Corporation, Richmond, VA (US); Ford Motor Co., Dearborn, MI (US)

( * ) Notice: Subject to any disclaimer, the term of this patent is extended or adjusted under 35 U.S.C. 154(b) by 166 days.

(21) Appl. No.: 11/005,160

(22) Filed: Dec. 6, 2004

(65) Prior Publication Data

US 2006/0122078 A1 Jun. 8, 2006

Related U.S. Application Data

(63) Continuation-in-part of application No. 11/003,549, filed on Dec. 3, 2004.

(51) Int. Cl.
*C10M 133/02* (2006.01)
*C10M 169/04* (2006.01)
*C10L 1/14* (2006.01)

(52) U.S. Cl. ..... 508/550; 508/459

(58) Field of Classification Search ..... 508/550, 508/459

See application file for complete search history.

(56) References Cited

U.S. PATENT DOCUMENTS 3,346,496 A * 10/1967 Neumann et al. ..... 508/261
3,502,722 A 3/1970 Neumann
4,022,752 A 5/1977 Horn et al.
4,029,702 A 6/1977 Piccolini
4,051,050 A 9/1977 Elliott et al.
4,098,710 A 7/1978 Elliott et al.
4,116,877 A * 9/1978 Outten et al. ..... 252/72
5,137,980 A * 8/1992 DeGonia et al. ..... 525/327.6
5,464,549 A * 11/1995 Sieberth ..... 508/232
5,498,356 A 3/1996 Kamakura et al.
5,614,483 A * 3/1997 Fessenbecker et al. ..... 508/550
5,806,336 A 9/1998 Sunaga et al.
6,143,702 A 11/2000 Nadasdi
6,235,687 B1 * 5/2001 Nadasdi et al. ..... 508/304
6,750,182 B1 6/2004 Nadasdi

FOREIGN PATENT DOCUMENTS

DE 1156401 10/1963
DE 2419968 12/1975

OTHER PUBLICATIONS

Fessenbecker, *"New Additive for the Hydrolytic Stabilisation of Ester Lubricants,"* Mannheim, Germany, Aug. 1995 (9 pgs.).

* cited by examiner

*Primary Examiner*—Glenn Caldarola
*Assistant Examiner*—Jim Goloboy
(74) *Attorney, Agent, or Firm*—MH2 Technology Law Group LLP

(57) ABSTRACT

There is provided a power transmitting fluid top treat composition including at least one carbodiimide. The top treat composition may be added to a power transmitting fluid comprising at least one carboxylic acid comprising about 2 to about 24 carbon atoms.

2 Claims, No Drawings

COMPOSITIONS COMPRISING AT LEAST ONE CARBODIIMIDE

This application is a continuation-in-part of U.S. application Ser. No. 11/003,549, filed Dec. 3, 2004, the disclosure of which is hereby incorporated by reference in its entirety.

DESCRIPTION OF THE INVENTION

1. Field of the Invention

The present disclosure relates to a power transmitting fluid top treat composition comprising at least one carbodiimide. The at least one carbodiimide may provide at least one property chosen from corrosion inhibition, improved lubricity, and improved lead compatibility. The fluid compositions disclosed herein include fluids that may be suitable for use in an automatic transmission, continuously variable transmission, a dual clutch transmission, and/or a manual transmission.

2. Background of the Invention

Carboxylic acids may be used in power transmitting fluids as corrosion inhibitors or friction modifiers. However, carboxylic acids may attack or corrode, bearings, bushings, or other components in transmissions that are made of lead. The corrosion is also known as leaching. The transmissions may fail or malfunction due to the corroded bearings. While replacing the lead bushing or bearing in the transmission would eliminate the problem, a more economical route would be to add a small amount of a fluid as a top treat, containing an acid scavenger, or neutralizer, to the power transmitting fluid.

U.S. Pat. No. 3,346,496 discloses lubricants containing from 1% to 2% by weight of carbodiimide as an antioxidant.

U.S. Pat. No. 5,498,356 discloses a lubricating oil composition for a refrigerating apparatus wherein carbodiimide compounds are added in an amount of from 0.05 to 15 parts by weight of synthetic oils for refrigerators.

U.S. Pat. No. 5,614,483 discloses that lubricant base materials containing ester groups may be stabilized by adding a small quantity of carbodiimides, such as 0.05 to 5 wt. %, for example 0.1 to 3 wt. %. The mixtures are suitable for process oils, fuels, heat transfer oils, engine oils, fats, metal processing fluids, aviation turbine oils, power transmission fluids, hydraulic oils, and refrigeration oils. The lubricant base materials containing ester groups—especially hydraulic oils are able to dissolve lead, zinc, and tin contained in metal objects which are in contact with the oils, such as the bearings of pumps.

U.S. Pat. No. 5,806,336 discloses a lubricating oil composition for a refrigerating apparatus wherein 0.01 to 10% by weight of carbodiimide may be added to a polyol-ester type oil.

U.S. Pat. No. 6,143,702 discloses lubricating oils of enhanced oxidation stability that are obtained by adding to the lubricating oil a mixture comprising n-phenyl-1-naphthyl amine and an acid scavenger such as carbodiimide. The lubricating oil base stock contains from about 0.05 to 5 wt. % of the carbodiimide.

U.S. Pat. No. 6,235,687 discloses lubricating oils exhibiting anti-rust properties that are obtained by adding to the lubricating oil an acidic anti-rust additive and an acid scavenger such as carbodiimide, in a specific sequence. The lubricating oil formulation preferably contains from about 0.01 to 5 wt. % carbodiimide acid scavenger.

U.S. Pat. No. 6,750,182 discloses an industrial oil of enhanced sludge resistance performance comprising a major amount of an ester base oil; an effective amount of an acid scavenger, such as carbodiimides present in an amount of 0.05 to 5 wt. %, and from about 1 to about 25 wt. % of a polyalpha olefin oil.

The fluid, which may be added as a top treat, with the acid scavenger would react with the carboxylic acid, and the resulting product would no longer attack or leach lead bearings. The acid scavenger or the product from the neutralization reaction should not affect the other properties of the power transmitting fluid, e.g., friction reduction, elastomer compatibility, etc.

SUMMARY OF THE INVENTION

According to various embodiments, there is provided a power transmitting fluid top treat composition comprising at least one carbodiimide. The top treat composition may be added to a power transmitting fluid comprising at least one carboxylic acid comprising about 2 to about 24 carbon atoms.

According to various embodiments, there is provided a method for reducing lead leaching of lead-containing machinery comprising providing a fluid top treat composition comprising at least one carbodiimide to a lubricating fluid composition present in the machinery.

According to various embodiments, there is provided a method for reducing corrosion of machinery comprising providing a fluid top treat composition comprising at least one carbodiimide to a lubricating fluid composition present in the machinery.

According to various embodiments, there is provided an anti-lead leaching top treat composition comprising at least one carbodiimide.

According to various embodiments, there is provided a method of providing lead compatibility to a power transmitting fluid, comprising adding to a power transmitting fluid a top treat composition comprising at least one carbodiimide.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE INVENTION

In accordance with the present disclosure, there is provided a power transmitting fluid top treat composition comprising at least one carbodiimide. The top treat composition may be added to a power transmitting fluid comprising at least one carboxylic acid comprising about 2 to about 24 carbon atoms.

The fluid composition includes, but is not limited to, fluid compositions such as those suitable for use as an automatic transmission fluid (ATF), a continuously variable transmission fluid, a manual transmission fluid, and a fluid used in a dual clutch transmission. The at least one carbodiimide may also be used in other fluid compositions, such as gear lubricants.

Top treat, as used throughout, is a fluid composition that may be added to a partially or a fully formulated (finished) power transmitting fluid. A top treat may be added at any time. For example, a top treat may be added by the manufacturer, e.g., as a factory fill; by the end user, e.g., as a service fill; or by any other party desiring to impart the properties of the top treat to a fluid.

The at least one carbodiimide may be present in the fluid composition in an amount sufficient to inhibit at least one of corrosion and rust and/or to improve at least one of lubricity and lead compatibility. For example, the at least one carbodiimide may be present in the composition in an amount ranging from about 0.1% to about 2% by weight, for example from about 0.3% to about 1.5%, and as a further example from about 0.4% to about 1% by weight, relative to the total weight of the composition.

Suitable carbodiimides are those of the formula (I):

$$(X)_m—[—N=C=N—Y—]_p—N=C=N—Y \quad (I)$$

wherein X and Y may be aromatic or aliphatic hydrocarbon residues comprising from about 6 to about 20 carbon atoms, which may bear aromatic, aliphatic and/or cycloaliphatic substituents with at least two carbon atoms in at least one ortho position relative to the carbodiimide group, for example, branched or cyclic aliphatic residues with at least three carbon atoms, and the carbodiimide group may be attached to an aromatic carbon, p may be an integer of from about 0 to about 100, for example, from about 0 to about 50, and X may contain free isocyanate groups.

When p=0 and m=1, the above formula (I) can be shown as X—N=C=N—Y, wherein X and Y may be as defined above. For example, carbodiimides of the formula I may be those having aromatic residues X and Y, for example, phenyl, which may be substituted in both ortho positions and optionally in para position relative to the carbodiimide groups by (cyclo)-aliphatic and/or aromatic residues, for example $C_1$-$C_6$ alkyl or phenyl, wherein one of these substituents in ortho position may be a methyl group. In embodiments, compounds may be those having aromatic rings X and Y which may be substituted in both adjacent positions relative to the carbodiimide group by (cyclo)aliphatic residues, wherein one of these substituents in ortho position may be a methyl group and the other contains at least two carbon atoms.

In embodiments, carbodiimides may be those which bear two or three substituents in ortho or ortho and para position relative to the carbodiimide group, at least one of which may be a branched aliphatic chain with at least three carbon atoms or a cycloaliphatic substituent with 5 or 6 carbon atoms, p may be, for example, 0 to 40.

The carbodiimides may be used as dimers, oligomeric or polymeric compounds or as mixtures thereof. Dimeric and polymeric carbodiimides ($p \geqq 3$) may be used.

According to the invention, suitable substituents adjacent to the carbodiimide group on the aromatic ring may be $C_2$-$C_{20}$ alkyl and/or cycloalkyl groups, such as ethyl, propyl, isopropyl, sec-butyl, tert-butyl, cyclohexyl, dodecyl, or also aryl and aralkyl residues with from about 6 to about 15 carbon atoms, such as phenyl, tolyl, benzyl, or naphthyl residues, and the like.

Suitable carbodiimides may be those which are substituted by isopropyl in the ortho positions relative to the carbodiimide group, and which are optionally also substituted by isopropyl in para position relative to the carbodiimide group. The following carbodiimides are cited by way of example:

(1)

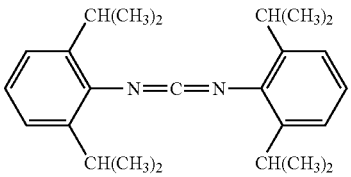

(2)

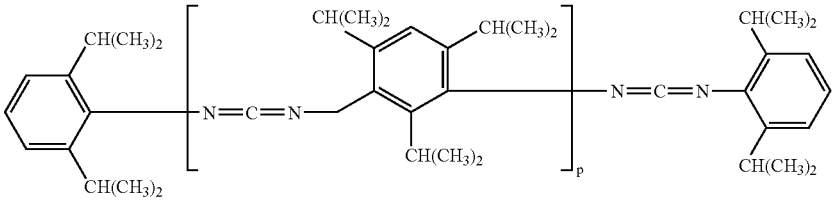

(3)

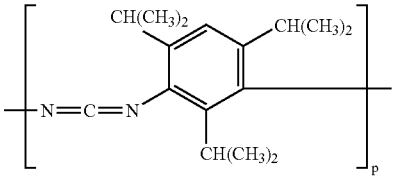

The carbodiimides of the formula (I) may be produced using per se known processes. One possible production process is described in DAS 25 37 685, the disclosure of which is hereby incorporated by reference. Organic polyisocyanates may be partially reacted to the desired degree in the presence of a suitable phosphorus compound and the catalyst may then be deactivated with a suitable halide, for example, an acid halide.

Polycarbodiimides, if they were produced from isocyanates, may contain reactive NCO groups and complexed monomeric isocyanates. Polycarbodiimides may, for example, be produced according to French patent 1 180 370, the disclosure of which is hereby incorporated by reference, from polyisocyanates with catalytic quantities of phospholines, phospholidines and the oxides and sulphides thereof. Further suitable polycarbodiimides may be produced from aromatic di- and polyisocyanates, which bear one or two aryl, alkyl, or aralkyl substituents in an ortho position relative to all NCO groups, wherein at least one of the substituents may have at least two carbon atoms, under the action of tertiary amines, basic-reacting metal compounds, carboxylic acid metal salts and non-basic organometallic compounds. Polycarbodiimides containing NCO groups may be modified by any isocyanate groups present being removed with reactive compounds containing hydrogen, such as alcohols, phenols, or amines (c.f. DE-AS 1 156 401 and DE-OS 2 419 968, the disclosures of which are hereby incorporated by reference).

Useful mono carbodiimides include those of formula:

$$R_1(N{=}C{=}N)R_2$$

wherein $R_1$ and $R_2$ may be the same or different and may be hydrogen, hydrocarbyl groups, or nitrogen and/or oxygen-containing hydrocarbyl groups. Thus, $R_1$ and $R_2$ can be $C_1$-$C_{12}$ aliphatic groups, $C_6$-$C_{18}$ aromatic groups, or aromatic-aliphatic groups.

Thus, $R_1$ and $R_2$ may be for example a hydrogen atom, alkyl groups such as methyl, ethyl, propyl, isopropyl, butyl, isobutyl, pentyl, 2-methylbutyl, hexyl, heptyl, octyl, 2-ethylhexyl, nonyl, decyl, undecyl, dodecyl and the like, alkenyl groups such as propenyl, butenyl, isobutenyl, pentenyl, 2-ethylhexenyl, octenyl and the like, cycloalkyl groups such as cyclopentyl, cyclohexyl, methyl-cyclopentyl, ethylcyclopentyl and the like, aryl groups such as phenyl, naphthyl and the like, alkyl substituted aryl groups such as alkyl substituted phenyl groups, for example toluyl, isopropylphenyl, diisopropylphenyl, triisopropylphenyl, nonylphenyl and the like, aralkyl groups such as benzyl, phenethyl and the like.

Non-limiting examples of monocarbodiimides include diisopropyl-carbodiimide, di-n-butyl-carbodiimide, methyl-tert-butyl-carbodiimide, dicyclohexyl-carbodiimide, diphenyl-carbodiimide, di-p-tolyl-carbodiimide, and 4,4'-didodecyl-diphenyl-carbodiimide. In embodiments, diphenyl-mono-carbodiimides which carry on the phenyl moiety at the ortho-position to the carbodiimide group various substituent groups, e.g., alkyl, alkoxy, aryl and aralkyl radicals, such as 2,2'-diethyl-di-phenyl-carbodiimide, 2,2'-di-isopropyl-diphenyl-carbodiimide, 2,2'-diethoxy-diphenyl-carbodiimide, 2,6,2,',6'-tetra-ethyl-diphenyl-carbodiimide, 2,6,2',6'-tetraisopropyl-di-phenyl-carbodiimide, 2,6,2',6'-tetraethyl-3,3'-dichloro-di-phenyl-carbodiimide, 2,2'-diethyl-6,6'-dichloro-diphenyl-carbodiimide, 2,6,2',6'-tetra-isobutyl-3,3'-dinitro-diphenyl-carbodiimide and 2,4,6,2',4',6'-hexaisopropyl-diphenyl-carbodiimide.

Suitable polycarbodiimides may be, for example, tetramethylene-ω,ω'-bis-(tert-butyl-carbodiimide), hexamethylene-ω,ω'-bis-(tert-butyl-carbodiimide), tetramethylene-ω,ω'-bis-(phenyl-carbodiimide) and those compounds which may be obtained by heating aromatic polyisocyanates such as 1,3-di-isopropyl-phenylene-2,4-di-iso-cyanate, 1-methyl-3,5-diethyl-phenylene-2,4-diisocyanate and 3,5,3',5'-tetra-isopropyl-diphenylmethane-4,4-di-isocyanate, in the presence of tertiary amines, basic metal compounds, carboxylic acid metal salts or non-basic organometallic compounds at a temperature of at least 120° C., according to the process of German Patent No. 1,156,401, the disclosure of which is hereby incorporated by reference.

In embodiments, the carbodiimides may be a sterically hindered aromatic carbodiimide. Suitable non-limiting examples include ADDITIN RC 8500® and STABAXOL 1® (N,N'-di(2,6-diisopropylphenyl)carbodiimide) by Rhein Chemie and STABILIZER 7000® (crystalline powder) and 7000F® (solid block) by Raschig.

The fluid composition may also comprise at least one carboxylic acid, for example, comprising, for example, from about 2 to about 24 carbon atoms. As a further, example, the at least one carboxylic acid may comprise from about 4 to about 18 carbon atoms, or as an even further example, from about 8 carbon atoms, such as caprylic acid.

In embodiments, there is disclosed a lubricant composition comprising a major amount of a base oil and a minor amount of at least one carbodiimide. A "major amount" may be understood to mean greater than or equal to about 50%. A "minor amount" may be understood to mean less than about 50%. The lubricant composition may be provided, for example, to machinery, such as an engine, a transmission, a lead bearing, and/or a lead bushing.

The base oil may be selected from, for example, paraffinic oils, naphthenic oils, aromatic oils, synthetic oils, derivatives thereof, and mixtures thereof.

The at least one carbodiimide may also be added to at least one additive in the appropriate proportions thereby providing a multifunctional additive package. Examples of at least one additive which may be used include, but are not limited to, dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, anti-wear agents, antifoam agents, viscosity index improvers, antirust additives, seal swell agents, metal deactivators, and air expulsion additives.

In selecting at least one additive, it is important to ensure that the selected additive is/are soluble or stably dispersible in an additive package and finished composition, are compatible with the other components of the composition, and do not interfere significantly with the performance properties of the composition, such as rust inhibition, corrosion inhibition, improved lubricity, and improved lead compatibility, needed or desired, as applicable, in the overall finished composition.

For the sake of convenience, the at least one additive may be provided as a concentrate for dilution. Such a concentrate forms part of the present disclosure and typically comprises from about 99 to about 1% by weight additive and from about 1 to about 99% by weight of solvent or diluent for the additive, which solvent or diluent may be miscible and/or capable of dissolving in a fluid composition, such as an automatic transmission fluid, in which the concentrate may be used. The solvent or diluent may, of course, be mineral oil (either paraffinic or naphthenic oils), aromatic oils, synthetic oils, or derivatives thereof. However, examples of other solvents or diluents include white spirit, kerosene, alcohols (e.g., 2-ethyl hexanol, isopropanol, and isodecanol), high boiling point aromatic solvents (e.g., toluene and xylene) and cetane improvers (e.g., 2-ethyl hexylnitrate). Of course, these may be used alone or as mixtures.

In general, the at least one additive may be employed in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid.

It will be appreciated that the individual components employed can be separately blended into the base fluid or can be blended therein in various subcombinations, if desired. Ordinarily, the particular sequence of such blending steps may not be crucial. Moreover, such components can be blended in the form of separate solutions in a diluent. According to various embodiments, however, the additive components may be blended in the form of a concentrate, as this simplifies the blending operations, reduces the likelihood of blending errors, and takes advantage of the compatibility and solubility characteristics afforded by the overall concentrate.

According to various embodiments, the power transmitting fluid composition may be used in the transmission of a vehicle, such as in a torque converter.

EXAMPLES

Testing was conducted by exposing samples of automatic transmission fluids containing a carboxylic acid at 150° C. for 50 hours in the presence of a lead-containing bushing. A control sample of an automatic transmission fluid without carboxylic acid was also exposed to a lead bushing for 50 hours at 150° C. The amount of lead in the oil was determined by an inductively coupled plasma atomic emission spectrometer (ICP AES, mfg. by Thermo-Jarrell Ash, a subsidiary of THERMO Electron, Co., of Waltham, Mass.) at the end of the test. The samples with high levels of lead compared to the control sample would indicate that lead leaching occurred. The inner diameters of the bushings were measured before and after the test. As lead is leached from the bearing, the bearing swells, and the internal diameter is reduced.

The automatic transmission fluids used in the examples are fully formulated fluids blended with mineral oils and an additive package. Additives typically used in a power transmitting fluid may include, but are not limited to, rust inhibitors, corrosion inhibitors, anti-wear additives, dispersants, oxidation inhibitors, foam inhibitors, viscosity index improvers, friction modifiers, extreme pressure additives, metal deactivators, pour point depressants, air entrainment additives, metallic detergents, and/or seal swell agents.

The results are shown in the following table:

| Fluid | Additive | Wt % additive | Difference in inner diameter | Lead, ppm |
|---|---|---|---|---|
| 1 | None (ATF with carboxylic acid) | 0.0 | 0.33 | 44 |

-continued

| Fluid | Additive | Wt % additive | Difference in inner diameter | Lead, ppm |
|---|---|---|---|---|
| 2 | Zinc Phenate | 0.2 | 0.2 | 55 |
| 3 | Zinc Sulfonate | 0.2 | 0.17 | 51 |
| 4 | Calcium overbased sulfonate | 0.3 | 0.04 | 22 |
| 5 | Magnesium overbased sulfonate | 0.3 | 0.07 | 43 |
| 6 | Tertiary Amine | 0.3 | 0.12 | 33 |
| 7 | Tertiary Amine | 0.3 | 0.14 | 38 |
| 8 | Sulfur additives | 0.4 | 0.08 | 18 |
| 9 | Compound A | 0.25 | 0.15 | 9 |
| 10 | Compound A | 0.50 | 0.02 | 4 |
| 11 | ATF Control (No carboxylic acid) | 0 | 0.04 | 2 |

Fluid 1 was an automatic transmission fluid with carboxylic acid. After 50 hours of exposure to a lead bushing at 150° C., the fluid contained 44 ppm of lead, and the bushing showed marked signs of swelling as the internal diameter decreased by 0.33 mm. Fluid 11 was a different ATF that did not contain a carboxylic acid. Under the same conditions, Fluid 11 contained only trace amounts of lead (2 ppm), and the internal diameter decreased by 0.02 mm.

Fluids 2-10 are examples of various additives that were added to Fluid 1 in an attempt to make it behave like Fluid 11. Some of the additives did decrease either the amount of lead or the difference in the internal diameter of the lead bushing. However, only Compound A, an aromatic carbodiimide, when used at a treat rate of 0.5 wt % in Fluid 1, reduced the amount of lead in the automatic transmission fluid and minimized the decrease in the internal diameter of the bushing. Fluid 1 with Compound A at 0.5 wt % most closely matched the performance of Fluid 11 with respect to lead leaching.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An automatic transmission fluid composition comprising a major amount of base oil comprising caprylic acid, and 0.5 wt. % bis-(2,6-diisopropylphenyl)-carbodiimide, wherein the fluid composition provides 4 ppm lead after exposing a lead bushing sample to the fluid composition for 50 hours at 150° C.

2. A method for reducing lead leaching in lead-containing automatic transmissions comprising providing a fluid composition comprising a major amount of base oil comprising caprylic acid, and 0.5 wt. % bis-(2,6-diisopropylphenyi)-carbodiimide, wherein the fluid composition provides 4 ppm lead after exposing a lead bushing sample to the fluid composition for 50 hours at 150° C.

* * * * *